United States Patent [19]

Oda

[11] Patent Number: 4,982,479

[45] Date of Patent: Jan. 8, 1991

[54] AUTOMATIC LOCKING SLIDER FOR SLIDE FASTENERS

[75] Inventor: Kiyoshi Oda, Namerikawa, Japan

[73] Assignee: Yoshida Kogyo, K.K., Tokyo, Japan

[21] Appl. No.: 479,152

[22] Filed: Feb. 13, 1990

[30] Foreign Application Priority Data

Feb. 13, 1989 [JP] Japan ..... 1-33487

[51] Int. Cl.[5] ..... A44B 19/30

[52] U.S. Cl. ..... 24/424; 24/419; 24/420

[58] Field of Search ..... 24/424, 419, 429, 420, 24/421, 422, 423, 425

[56] References Cited

U.S. PATENT DOCUMENTS

| | | | |
|---|---|---|---|
| 2,450,550 | 10/1948 | Griffin et al. . | |
| 2,867,881 | 1/1959 | Morin | 24/419 |
| 2,882,576 | 4/1959 | Morin . | |
| 2,900,695 | 8/1959 | Morin | 24/424 |
| 3,284,864 | 11/1966 | Howell | 24/424 |
| 3,368,249 | 2/1968 | Fukuroi | 24/420 |
| 3,924,306 | 12/1975 | Oda | 24/424 |
| 4,069,555 | 1/1978 | Toepelt | 24/424 |
| 4,790,050 | 12/1988 | Ishii | 24/419 |

FOREIGN PATENT DOCUMENTS

| | | | |
|---|---|---|---|
| 648831 | 8/1937 | Fed. Rep. of Germany . | |
| 1610438 | 4/1971 | Fed. Rep. of Germany . | |
| 2441565 | 3/1975 | Fed. Rep. of Germany | 24/424 |
| 1049534 | 12/1953 | France . | |
| 1194766 | 11/1959 | France . | |
| 2242049 | 3/1975 | France . | |
| 62-102407 | 6/1987 | Japan . | |
| 661719 | 11/1951 | United Kingdom . | |
| 1066874 | 4/1967 | United Kingdom . | |

*Primary Examiner*—Victor N. Sakran

*Attorney, Agent, or Firm*—Hill, Van Santen, Steadman & Simpson

[57] ABSTRACT

An automatic locking slider for slide fasteners comprises a slider body including a pair of upper and lower wings joined together, the upper wing having a pair of opposed lugs provided protuberantly on its upper surface; a locking member fitted between the lugs and pivotted at its middle to thereto, the locking member having at its lower end a locking prong; a spring member provided on the slider body for normally urging the front end of the locking member upwardly so as to bring the locking prong into locking disposition; and a pull tab for pulling up the rear end of the locking member so as to bring the locking prong out of locking disposition for reciprocation of the slider. The lugs are so bluged roundedly as to have their respective outer sides to extend substantially to and merge into the edge of the front end and as to substantially enclose a front half of the locking member on its opposed sides.

7 Claims, 5 Drawing Sheets

AUTOMATIC LOCKING SLIDER FOR SLIDE FASTENERSBACKGROUND OF THE INVENTION

1. Field of the Invention

The present invention generally relates to an automatic locking slider for slide fasteners and in particular to an automatic locking slider of the type having a locking member pivotally supported by and between a pair of opposed lugs provided on the upper surface of the slider.

2. Description of the Prior Art

A typical conventional automatic locking slider of the type described is disclosed in French Patent No. 1049534. As shown in FIGS. 9 and 10 of the drawings appended hereto, the conventional automatic locking slider comprises a slider body 121 including a pair of upper and lower wings 122, 122' joined together at their front ends, the upper wing 122 having a pair of opposed thinned lugs 123, 123 protuberantly provided substantially centrally on its upper surface. A thinned locking member 125 is partly disposed between the opposed lugs 123, 123 and pivottaly mounted on a pivotal pin 124 secured between the opposed lugs 123, 123. The locking member 125 projects exposed forwardly beyond the front edges of the lugs 123, 123.

The conventional automatic locking slider has several disadvantages. The locking member 125 is hardly protected by the lugs 123, 123, in other words, the locking member 125 is exposed widely at its front and rear portions, so that it is very vulnerable or liable to stresses applied by other things. Consequently, the locking prong of the locking member 125 would be apt to come out of locking engagement with fastener elements accidentally, so that the conventional automatic locking slider suffers from unreliability in automatic locking function.

Furthermore, when severe stresses were exerted directly on the locking member 125, the lugs 123, 123 and the locking members 125 are liable to deformation or damage. Since the mechanical strength of such parts is generally proportioned to the size of a slider as a whole, such deformation or damage is more likely to occur in a small slider.

Still furthermore, the lugs 123, 123 and the locking member 125 disposed therebetween are both less in thickness and project considerably high for the area on the upper surface of the upper wing 122 which they occupy, so that they are inclined to irritate the skin of the wearer or otherwise impart objectionable uncomfortable feeling to him. The smaller is a slider, the more protrusive feel the thinned lugs 123, 123 and the locking member 125. Therefore, the above-mentioned conventional construction does not fit an extremely small slider, in particular.

SUMMARY OF THE INVENTION

With the foregoing difficulties in view, it is therefore an object of the present invention to provide an aucomatic locking slider which is very strong and hence enjoys a stable and reliable automatic locking function for a prolonged period of time.

It is another object of the present invention to provide an aucomatic locking slider which is attractive and mild in appearance and touches soft and comfortable.

According to the present invention, there is provided an automatic locking slider for slide fasteners comprising a slider body including a pair of upper and lower wings joined together, the upper wing having a pair of opposed lugs provided protuberantly on its upper surface adjacent its front end to thus define a groove therebetween; a locking member fitted in the groove and pivotted at its middle to the opposed lugs, the locking member having at its rear end a locking prong; a spring member provided on the slider body for normally urging the front end of the locking member upwardly so as to bring the locking prong into locking disposition; and a pull tab for pulling up the rear end of the locking member so as to bring the locking prong out of locking disposition for reciprocation of the slider; the lugs being so bulged roundedly as to have their respective outer sides to extend substantially to and merge into the edge of the front end and as to substantially enclose a front half of the locking member on its opposed sides.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
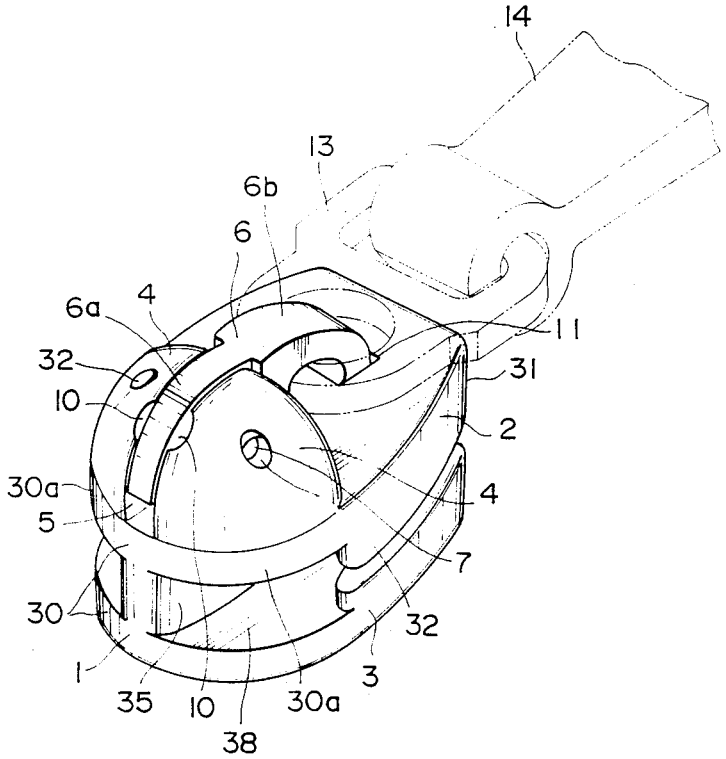
FIG. 1 is an enlarged fragmentary perspective view of a automatic locking slider according to the present invention.
Figure 2:
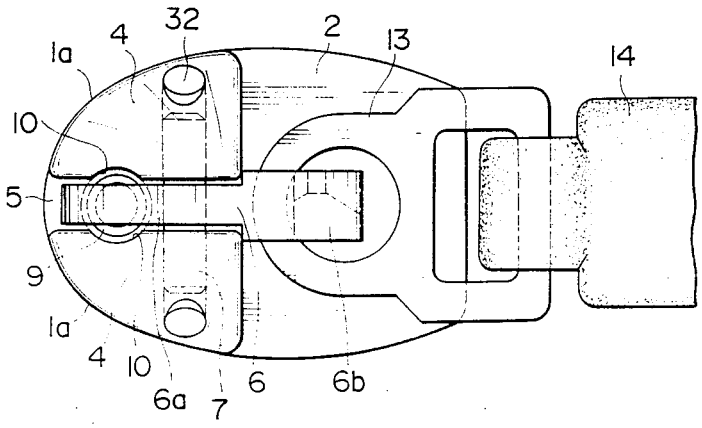
FIG. 2 is a fragmentary plan view of the automatic locking slider of FIG. 1.
Figure 3:
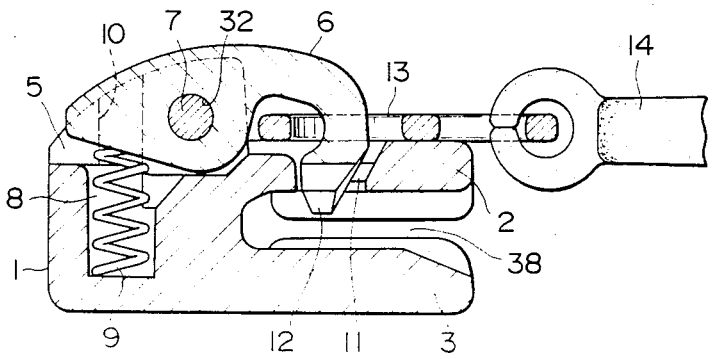
FIG. 3 is a longitudinal cross-sectional view of the automatic locking slider of FIG. 1.
Figure 4:
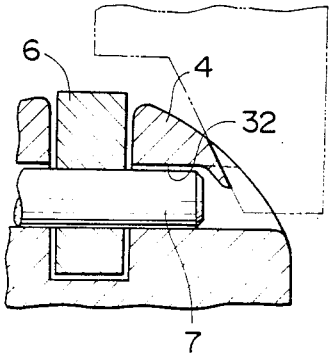
FIG. 4 is a fragmentary lateral cross-sectional view of a pair of roundedly bulged lugs and a locking member, interposed therebetween, of the automatic locking slider of FIG. 1.

FIGS. 1 through 3 show an automatic locking slider for slide fasteners embodying the present invention. The automatic locking slider broadly comprises a slider body 1, a pull tab support 13 pivotally joined to the slider body 1 and a pull tab 14 pivotally joined to the pull tab support 13. The slider body 1 includes a pair of upper and lower wings 2, 3 and has a front end 30 and a converged rear end 31. The upper and lower wings 2, 3 are joined to each other at the front end 30 by a neck portion 35 to thus define therebetween a Y-shaped channel 38 for passage of fastener element rows of slide fastener stringers to open and close the slide fastener. A pair of lugs 4, 4 are protuberantly mounted on the upper surface adjacent the front end 30 of the upper wing 2 and disposed in opposed relation to each other to thus define a groove 5 between the respective confronting inner sides of the lugs 4, 4. Each of the lugs 4, 4 is so bulged roundedly on its outer side as to have the convex outer side substantially extend to and merge into the edge 30*a* of the front end 30, as best shown in FIG. 1. A locking member 6 is fitted at its front half 6*a* in the groove 5. As better shown in FIGS. 1 and 3, the front half 6*a* of the locking member 6 is substantially enclosed on its opposed sides by the bulged lugs 4, 4, so that the former is sufficiently protected by the latter against deformation or damages even under severe stresses exerted on the front half 6*a* of the locking member 6. The locking member 6 is pivoted at its a middle to a pivotal pin 7 supported between the opposed lugs 4, 4 so as to rotate on the pivotal pin 7. The pivotal pin 7 is inserted through a pair of aligned through holes 32, 32 formed in the lugs adjacent their rear ends. The pivotal pin 7 is secured to the lugs 4, 4 against detachment from the through holes 32, 32 by swaging overhanging slant edges of the holes 32, 32 to the ends of the pivotal pin 7. As best seen in FIG. 4, since it is the thinned slant edge of triangular cross-section overhanging the hole 32 that is swaged for the purpose above-mentioned, the swaging can be effected very yieldingly or easily and the thus swaged portions are not so conspicuous. As better shown in FIGS. 1 and 2, the rear half 6*b* of the locking member 6 which extends exposed out of between the lugs 4, 4 is formed greater in width than the front half 6*a* lying within between the lugs 4, 4. This advantageously helps to reinforce the rear half 6*b* of the locking member 6 left unprotected and hence the locking member 6 as a whole, thereby conducing to stabilization of the automatic locking function of the slider. As shown in FIGS. 1 and 3, the locking member 6 is formed on its upper side so arcuate as to confirm with the convexities of the bulged lugs 4, 4, to thus help the upper surface of the upper wing 2 as a whole look and feel rounded and mild.

A cylindrical blind bore 8 is formed in the neck portion 35 and communicates at its upper end with the groove 5. A compression coil spring 9 is fitted in the blind bore 8 and normally urges the front end of the locking member 6 upwardly so as to rotate the locking member 6 clockwise, as viewed in FIG. 3. A pair of concave recesses 10, 10 are formed in the opposed inner surfaces of the lugs 4, 4 in confronting relation to each other, the concave recesses 10, 10 merging into the relevent confronting parts of the inner periphery of the blind bore 8, for facilitating insertion of the compression coil spring 9 into the blind bore 8 during assemblage of the automatic locking slider.

The upper wing 2 has adjacent to the converged rear end 31 a through opening 11 communicating with the Y-shaped channel 38.

The rear half 6*b* of the locking member 6 is bent arcuately and terminates in a locking prong 12. Normally, the locking member 6 is rotated clockwise, as viewed in FIG. 3, under the bias of the compression coil spring 9 fitted in the blind bore 8, so that the locking prong 12 passes through the opening 11 into the Y-shaped channel 38 for locking engagement with the fastener elements of the slide fastener stringers within the Y-shaped channel 12, thus bringing the slider in locked disposition. For unlocking the slider, a pull tab 14 is pulled upwardly to thus rotate the locking member 6 anti-clockwise (as viewed in FIG. 3), thereby bringing the locking prong 12 out of locking engagement with the fastener elements, so that the slider can now reciprocate on and along the fastener element rows smoothly for opening and closing the slide fastener.

As best shown in FIG. 1, the pull tab 14 is joined to the locking member 6 via the pull tab support 13 so that the pull tab 14 is yieldingly and freely movable in various directions under stresses exerted thereon. This means that the pull tab 14 will not resist to the skin of the wearer, thus imparting the wearer soft and comfortable touch.

Figure 5:
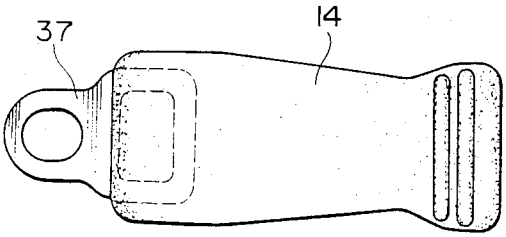
FIG. 5 is a fragmentary plan view of another embodiment of the present invention.

FIG. 5 shows another embodiment of the present invention wherein a pull tab 14 is made of flexible materials such as flexible synthetic resin or flexible synthetic rubber and has a connecting ring 37 planted into its one end for direct connection with the locking member 6. Such use of flexible materials for the pull tab 14 further would help to make the slider as a whole feel more soft and mild.

Figure 6:
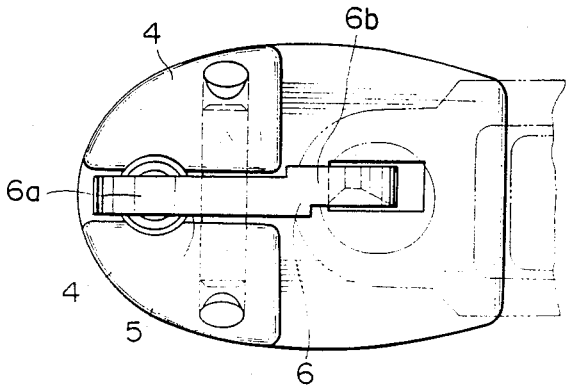
FIG. 6 is a plan view of a pull tab according to still another embodiment of the present invention.

FIG. 6 shows still another embodiment of the present invention wherein the rear half 6*b* of the locking member 6 extending beyond between the lugs 4, 4, although having substantially the same width of the front half 6*a* lying within the groove 5, is slightly offset relative to the front half 6*a*, so as to ensure that the locking prong 12 comes into interlocking engagement with between adjacent fastener elements of the slide fastener stringers.

Figure 7:
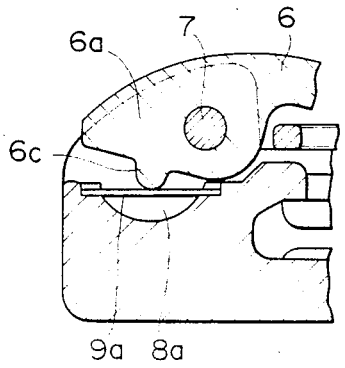
FIG. 7 is a fragmentary cross-sectional view of an automatic locking slider according to yet another embodiment of the present invention.

FIG. 7 shows yet another embodiment wherein, instead of the cylindrical blind bore 8, a concave recess 8*a* is formed in the upper surface of the upper wing 2 adjacent the front end 30 and, instead of the compression coil spring 9, a flat plate spring 9*a* is laid over the concave recess 8*a*. The locking member 6 is provided on the lower surface of the front end with an abutment projection 6*c*. The plate spring 9*a* acts on the projection 6*a* so as to urge the front end of the locking member 6 upwardly to thus rotate the locking member 6 clockwise as viewed in FIG. 7.

Figure 8:
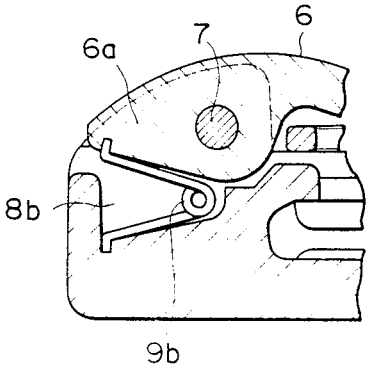
FIG. 8 is a fragmentary cross-sectional view of an automatic locking slider according to still another embodiment of the present invention.
Figure 9:
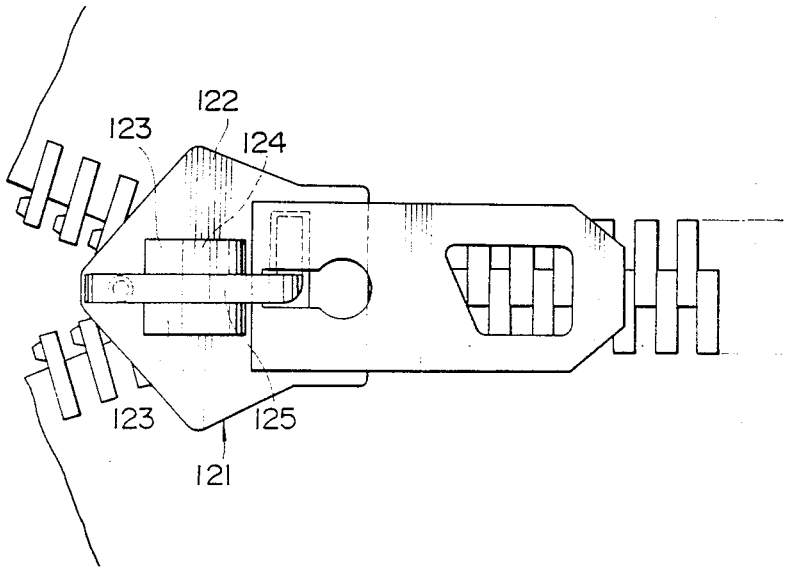
FIG. 9 PRIOR ART
FIG. 9 is a plan view of an automatic locking slider according to prior art, showing it as mounted on slide fastener stringers.
Figure 10:
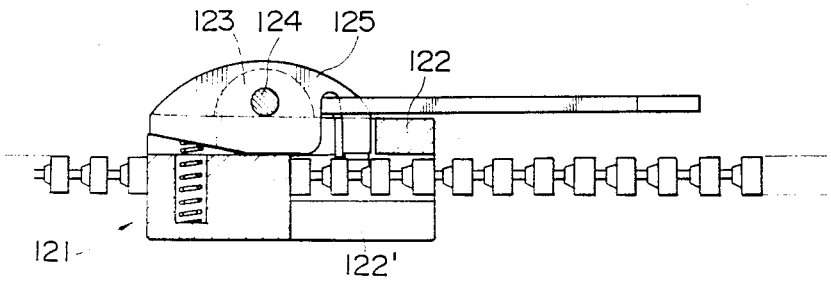
FIG. 10 PRIOR ART
FIG. 10 is a longitudinal cross-sectional view of the prior art slider of FIG. 9.

FIG. 8 shows still another embodiment wherein the upper wing 2 has a furrow 8*b* in its upper surface adjacent to the front end 30, whose bottom slants downwardly toward the front end 30. A tortional helical spring 9*b* is laid in the slant-bottomed furrow 8*b* and is secured at its one end to the bottom of the furrow 8*b* and at the other end to the lower surface of the front end of the locking member 6 so as to urge the front end of the locking member 6 upwardly to thus rotate the locking member 6 clockwise as viewed in FIG. 8.

With the construction of the present invention mentioned hereinabove, the following advantages can be enjoyed. Since the opposed lugs 4, 4 are so bulged roundedly as to substantially enclose the front half 6*a* of the locking member 6 on its opposed sides which front half would be otherwise liable to deformation or damage, the locking member 6 is less subjected to stresses exerted on the slider, thereby enjoying reliable locking function for a prolonged period of time.

Furthermore, forming the rear half 6*b* of the locking member 6 left unprotected greater in width than the front half 6*a* would reinforce the rear half 6*b* and hence the locking member 6 as a whole, thus conducing to further enhancement of reliability of automatic locking function.

Still furthermore, the lugs 4, 4 are so bulged roundedly as to extend substantially to and merge into the edge 30*a* of the front end 30 of the upper wing 2, thereby help to make the slider as a whole look attractive and mild and touches soft and comfortable. Therefore, the construction of the present invention is advantageous particularly in being applied to a small slider in which a locking member 6 occupys a larger space relatively to the whole size of the slider.

Obviously, various modifications and variations of the present invention are possible in the light of the above teaching. It is therefore to be understood that within the scope of the appended claims the invention may be practiced otherwise than as specifically described.

What is claimed:

1. An automatic locking slider for slide fasteners comprising a slider body including a pair of upper and lower wings joined together, the upper wing having a pair of opposed lugs provided protuberantly on its upper surface adjacent its front end to thus define a groove therebetween; a locking member fitted in the groove and pivotted at its middle to the opposed lugs, the locking member having at its rear end a locking prong; a spring member provided on the slider body for normally urging the front end of the locking member upwardly so as to bring the locking prong into locking disposition; and a pull tab for pulling up the rear end of the locking member so as to bring the locking prong out of locking disposition for reciprocation of the slider; the lugs being so bulged roundedly as to have their respective outer sides to extend substantially to and merge into the edge of the front end and as to substantially enclose a front half of the locking member on its opposed sides.

2. An automatic locking slider for slide fasteners according to claim 1, a rear half of the locking member which extends out of between the opposed lugs being greater in width than the front half lying between the opposed lugs.

3. An automatic locking slider for slide fasteners according to claim 1 or 2, the automatic locking slider further including a pull tab support which is pivotally connected at its one end with the locking member and at the other end with the pull tab, so that the pull tab is yieldingly movable in various direction under stresses exerted thereon.

4. An automatic locking slider for slide fasteners according to claim 1 or 2, the pull tab being made of flexible material, the pull tab including a connecting ring planted into one end thereof.

5. An automatic locking slider for slide fasteners according to claim 1, the slider body having a cylindrical blind bore formed in a neck portion thereof so as to communicate at an upper end thereof with the groove; the spring member comprising a compression coil spring fitted in the blind bore for normally urging the front end of the locking member upwardly so as to bring the locking prong in locking disposition; the opposed lugs having a pair of concave recesses formed in respective opposed inner surfaces thereof in confronting relation to each other, the concave recesses merging into confronting parts of the inner periphery of the blind bore.

6. An automatic locking slider for slide fasteners according to claim 1, the locking member having an abutment projection provided at a lower surface of its front end; the slider body having a recess formed in an upper surface of the upper surface of the upper wing so as to communicate at its upper end with the groove; the spring member comprising a plate spring laid over the recess and acting on the abutment projection for normally urging the front end of the locking member upwardly to bring the locking prong in locking disposition.

7. An automatic locking slider for slide fasteners according to claim 1, the slider body having a furrow formed in an upper surface of the upper wing so as to communicate at an upper end thereof with the groove; the spring member comprising a torsional helical spring laid in the furrow, the spring being secured at a first end to a bottom of the furrow and at a second end to the front end of the locking member for normally urging the front end of the locking member upwardly to thus bring the locking prong in locking disposition.

* * * * *